US010477949B2

(12) United States Patent
Wall

(10) Patent No.: US 10,477,949 B2
(45) Date of Patent: Nov. 19, 2019

(54) BELT KEEPER

(71) Applicant: Brandon Scott Wall, Stevensville, MI (US)

(72) Inventor: Brandon Scott Wall, Stevensville, MI (US)

( * ) Notice: Subject to any disclaimer, the term of this patent is extended or adjusted under 35 U.S.C. 154(b) by 0 days.

(21) Appl. No.: 16/205,342

(22) Filed: Nov. 30, 2018

(65) Prior Publication Data

US 2019/0166984 A1 Jun. 6, 2019

Related U.S. Application Data

(60) Provisional application No. 62/593,322, filed on Dec. 1, 2017.

(51) Int. Cl.
*A45F 5/02* (2006.01)
*A41F 9/00* (2006.01)

(52) U.S. Cl.
CPC ..... *A45F 5/021* (2013.01); *A41F 9/002* (2013.01); *A45F 2200/0508* (2013.01); *A45F 2200/0566* (2013.01); *A45F 2200/0591* (2013.01)

(58) Field of Classification Search
CPC ..... A45F 5/021; A45F 2200/0508; A45F 2200/0591; A45F 2200/0566; A41F 9/002
USPC ..... 224/183
See application file for complete search history.

(56) References Cited

U.S. PATENT DOCUMENTS 4,419,794 A * 12/1983 Horton, Jr. ..... A45F 5/02 224/197
5,054,170 A * 10/1991 Otrusina ..... A45F 5/02 224/197
5,464,136 A * 11/1995 Eddy ..... A45F 5/02 2/308
5,586,969 A * 12/1996 Yewer, Jr. ..... A61F 5/028 128/101.1
5,604,958 A * 2/1997 Anscher ..... A45C 7/0086 224/197
5,683,022 A * 11/1997 Evans ..... A41F 9/002 224/583
5,722,576 A * 3/1998 Rogers ..... A45F 5/02 224/195
5,881,933 A * 3/1999 Rogers ..... A41F 9/02 224/195
5,941,438 A * 8/1999 Price ..... A41F 9/002 224/660

(Continued)

*Primary Examiner* — Nathan J Newhouse
*Assistant Examiner* — Lester L Vanterpool
(74) *Attorney, Agent, or Firm* — Botkin & Hall, LLP

(57) ABSTRACT

A duty belt and dress belt retainer clip system has a duty belt clip that attaches to the duty belt and has a magnet for engaging a magnet engagement portion on a dress belt clip. Dress belt clips are positioned around a dress belt with the magnet engagement portions facing outward and corresponding duty belt clips are positioned around a duty belt with the magnets facing the magnet engagement portions. The magnet engagement portion has trap walls that surround a magnet engagement wall. The trap walls prevent the magnet from sliding off of the magnet engagement portion. The duty belt clips include a duty belt retention clip that pivots between a locked position that captures the duty belt and an unlocked position that allows removal from the duty belt. Optional fasteners extend through the dress belt to affix the dress belt to the dress belt clips.

13 Claims, 7 Drawing Sheets

(56) References Cited

U.S. PATENT DOCUMENTS

| | | | | |
|---|---|---|---|---|
| 5,957,421 | A * | 9/1999 | Barbour | A45F 5/02 224/197 |
| 6,161,741 | A * | 12/2000 | French | F41C 33/0227 224/192 |
| 6,233,788 | B1 * | 5/2001 | Choy | A45F 5/02 224/197 |
| 6,578,745 | B1 * | 6/2003 | Taylor | A45F 5/02 224/197 |
| 7,762,440 | B2 * | 7/2010 | Cook | F41C 33/046 2/338 |
| 7,832,606 | B2 * | 11/2010 | Sin | A45F 5/02 224/197 |
| 8,510,868 | B2 | 8/2013 | Mongan et al. | |
| 9,339,102 | B2 * | 5/2016 | Iosilevich | A45F 5/021 |
| 2007/0033698 | A1 | 2/2007 | Long | |
| 2008/0237282 | A1 * | 10/2008 | Sin | A45F 5/02 224/197 |
| 2009/0095785 | A1 | 4/2009 | Woolery | |
| 2009/0289090 | A1 * | 11/2009 | Fullerton | A45F 5/02 224/183 |
| 2012/0132682 | A1 | 5/2012 | Mongan et al. | |
| 2013/0254976 | A1 | 10/2013 | Aravena | |
| 2015/0135409 | A1 | 5/2015 | Mongan et al. | |

* cited by examiner

20

32
36
12
22
26
52
50
10
66
102
28
40
62
24
38
42
84
11
34
112
63
29
100
108
106
82
30
104

BELT KEEPER

CROSS REFERENCE TO RELATED APPLICATIONS

This application claims the benefit of U.S. Provisional Application No. 62/593,322, filed Dec. 1, 2017, the disclosures of which are hereby incorporated by reference.

BACKGROUND OF THE INVENTION

Police officers use what is commonly referred to as a "belt keeper" to hold/attach an outer duty belt to the inner dress belt worn by officers. For clarity, dress belts worn by officers are also referred to as trouser belts or garrison belts. These belts will be referred to herein as dress belts even though the specific belt may not be a traditional "dress belt" but a more utilitarian trouser belt or a garrison belt. Because of the number and size of components attached to the duty belt, feeding the duty belt through standard pant belt loops is impossible. Belt keepers help prevent the duty belt from moving up or down on the waistline in normal activities and more importantly when pulling tools such as firearms out of the duty belt. As is known in the art, current belt keepers are small leather or nylon straps that wrap around both the duty belt and dress belt tightly at the waistline to lock them together with snap or hook-and-loop fasteners. A normal sized officer typically uses four belt keepers to hold his/her belts together. At the beginning and end of each day, or if an officer has to use the facilities, the snaps have to be unsnapped and the keeper straps removed in order to separate the duty belt from the dress belt worn on the trousers. The keepers must be then reapplied after using the facilities a process that can take several minutes. Another concept is the use of hook-and-loop strips down the middle of the outer surface of the dress belt and inner surface of the duty belt. A major problem with hook-and-loop strips is that the material degrades over time and police departments have to buy all new dress and duty belts to make the transition. The prior art strap belt keeper is currently in use by law enforcement personnel and comprises a nylon or leather strap. The prior art belt keeper can have two sets of posts and sockets secured to a strap that allows an individual to snap multiple belt keepers around a duty belt and dress belt to secure the duty belt to the dress belt. An improved system to hold the duty belt to the dress belt is needed.

SUMMARY OF THE INVENTION

The present disclosure describes a belt clip system that uses a dress belt clip that is secured to a dress belt and a duty belt clip that is secured to a duty belt. The dress belt clip and duty belt clip are releasably held together using a permanent magnet that is affixed to the duty belt clip. The dress belt clip has a magnet retention portion with trap walls that extend outwardly to create an effective pocket for a magnet. The trap walls prevent the magnet from sliding off. The duty belt clip and dress belt clip are formed from spring steel or equivalent resilient material that maintains biased pressure to hold the clip to its corresponding belt. The duty belt clip may further include a retention clip that pivots between a locked and unlocked position. In the locked position, the terminal end of the retention clip is located between an overhanging portion and an outside wall to completely surround and capture the duty belt. In the unlocked position, the clip can be removed from the duty belt. The duty belt clip overhanging portion can receive additional hooks or other removable devices.

The magnet retention portion can be integrated into a dress belt with it recessed from an outside surface with upper and lower trap walls forming the effective pocket for the magnet.

DESCRIPTION OF THE PREFERRED EMBODIMENT

Figure 1:
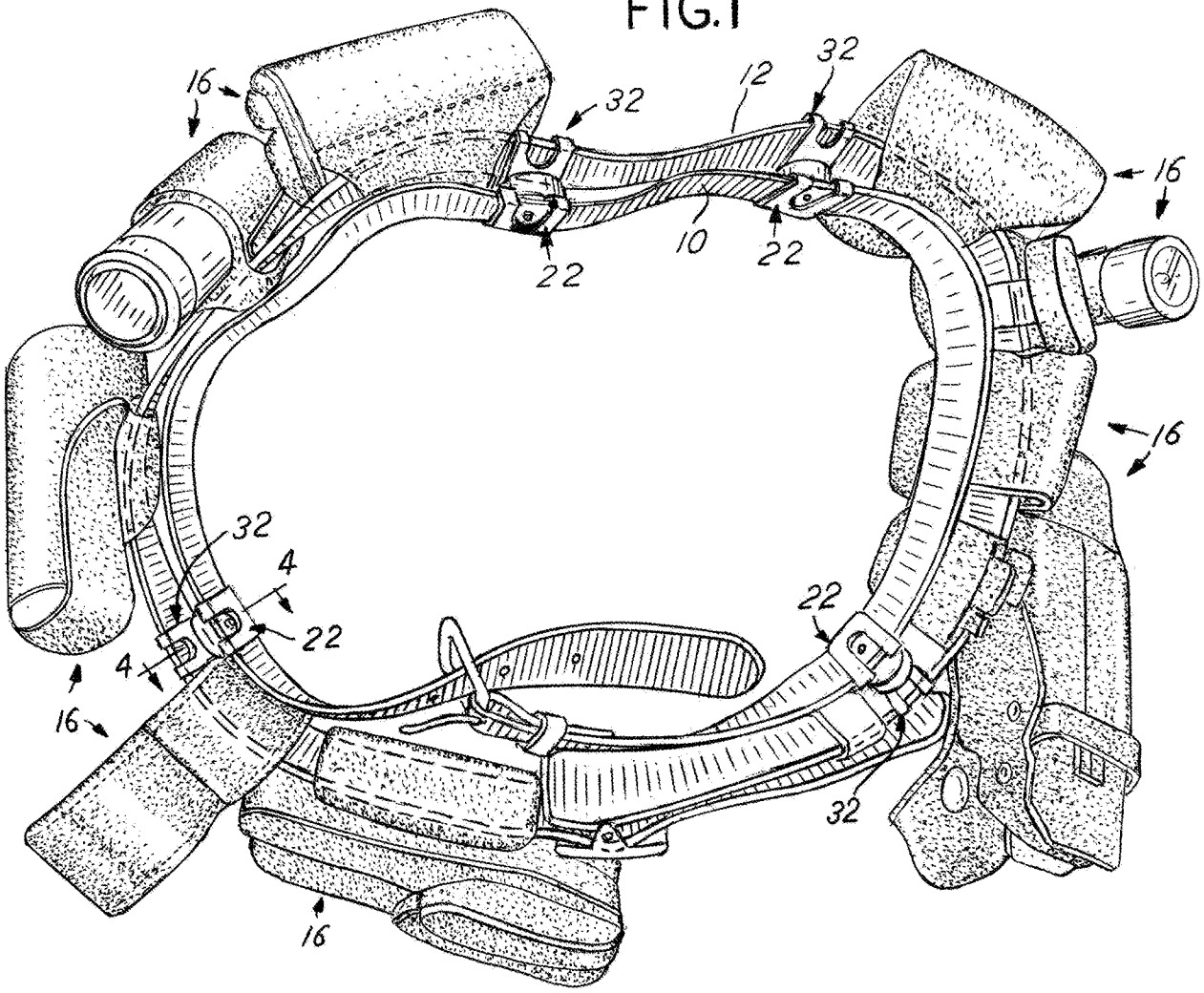
FIG. 1 is a top view of the system in use on a duty belt and dress belt.
Figure 2:
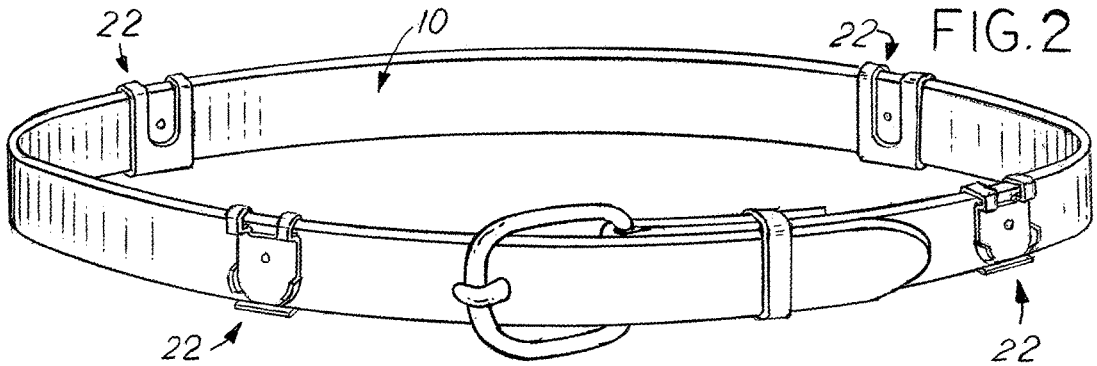
FIG. 2 is an isometric view of the dress belt in FIG. 1.
Figure 3:
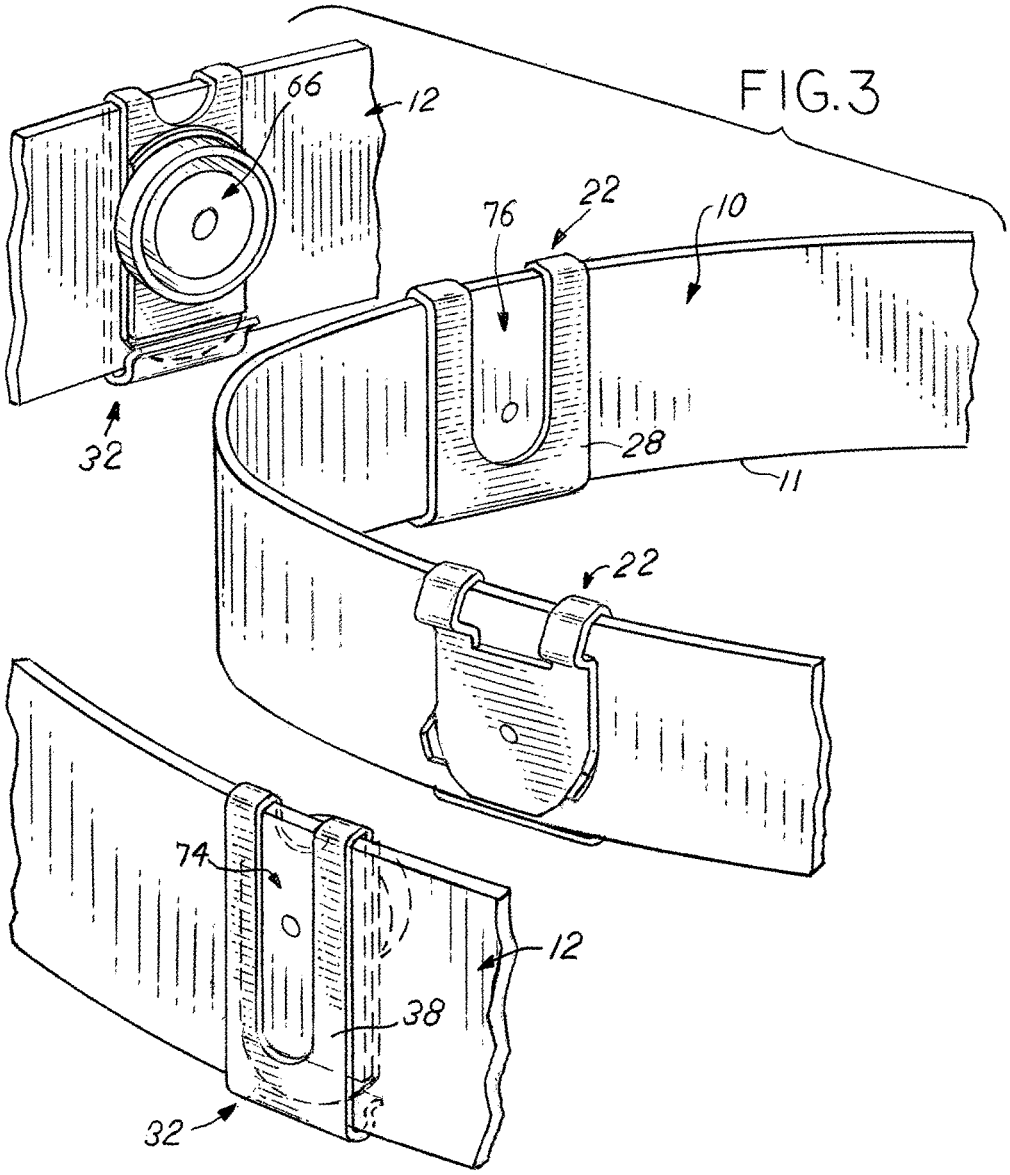
FIG. 3 is a partial of the system as shown in FIG. 1.

A magnetic belt keeper system 20 is shown in FIGS. 1 and 3 and is used to attach a dress belt 10 to a duty belt 12. The dress belt 10 is connected to the user's pants through belt loops and is worn to hold up their pants. While the magnetic belt keeper system 20 described herein is disclosed as being used by law enforcement, it should be understood that tool belts used by personnel involved in construction, service, or electrical work and the like can employ the belt keeper system 20. The belt keeper system 20 holds the duty belt 12 to the dress belt 10 using magnetism. As is known in the art, a duty belt 12 holds accessories 16, such as batons, guns, knives, phones, radios, and other necessary items. These items are large and heavy. As shown in FIG. 1, four magnetic belt keepers 20 are used for normal size individuals, but other amounts are contemplated, depending on the size of the user and the weight of the devices that are held by the duty belt 12.

Figure 4:
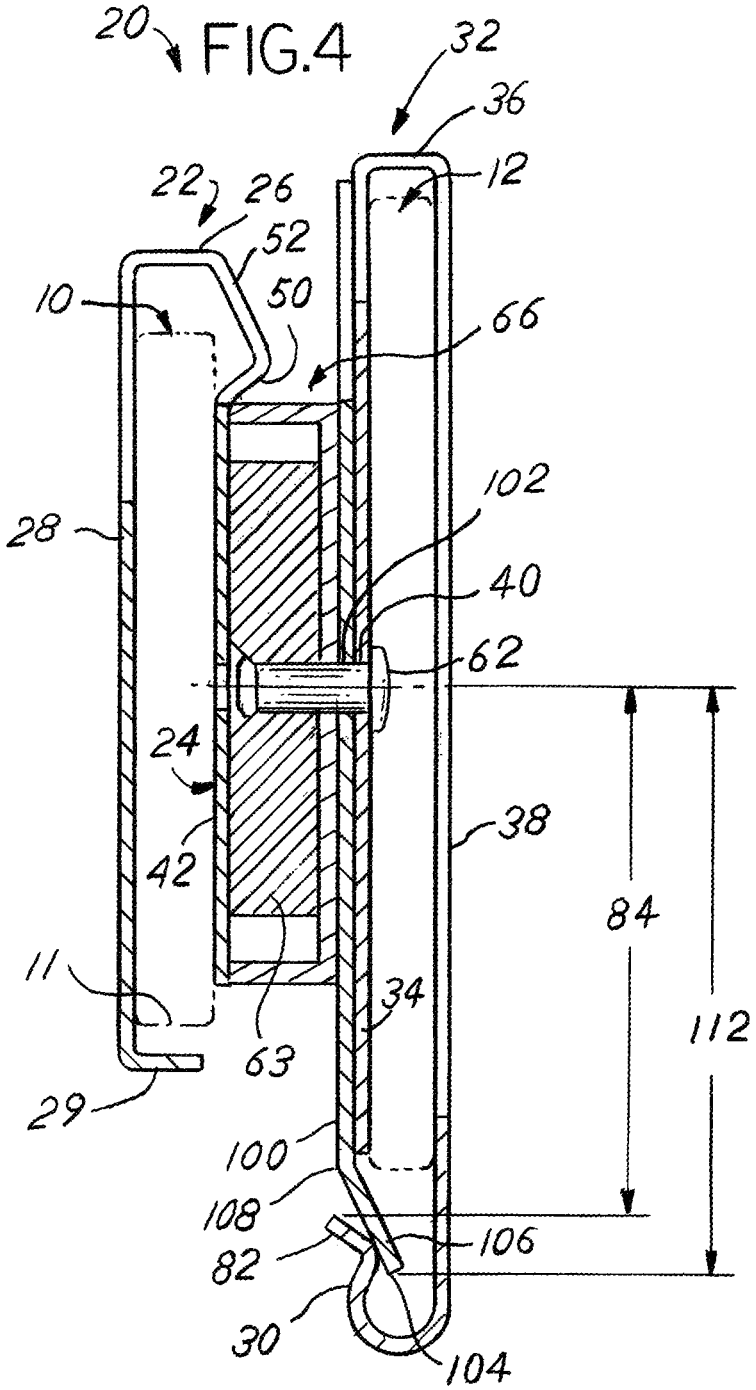
FIG. 4 is section view 4-4 of the system as shown in FIG. 1 with the duty belt and dress belt in hidden lines.

The belt keeper system 20 uses a dress belt clip 22 and a duty belt clip 32, shown in FIG. 4. The duty belt clip 32, shown separately in FIG. 6, has a powerful neodymium cup magnet 66 secured to a magnet support wall 34 facing the dress belt clip 22. When the dress belt clip 22 is placed near a duty belt clip 32, the magnetic force of cup magnet 66 secures the duty belt clip 32 to the dress belt clip 22. The only way to disengage the duty belt clip 32 from the dress belt clip 22 is by using an outward pulling force that overcomes the magnetic force from the cup magnet 66. The duty belt 12 is secured around the dress belt 10 and overlays it, which prevents accidental disengagement of the duty belt clips 32 from the dress belt clips 22 when removing a stubborn tool or accessory from the duty belt 12.

Figure 5:
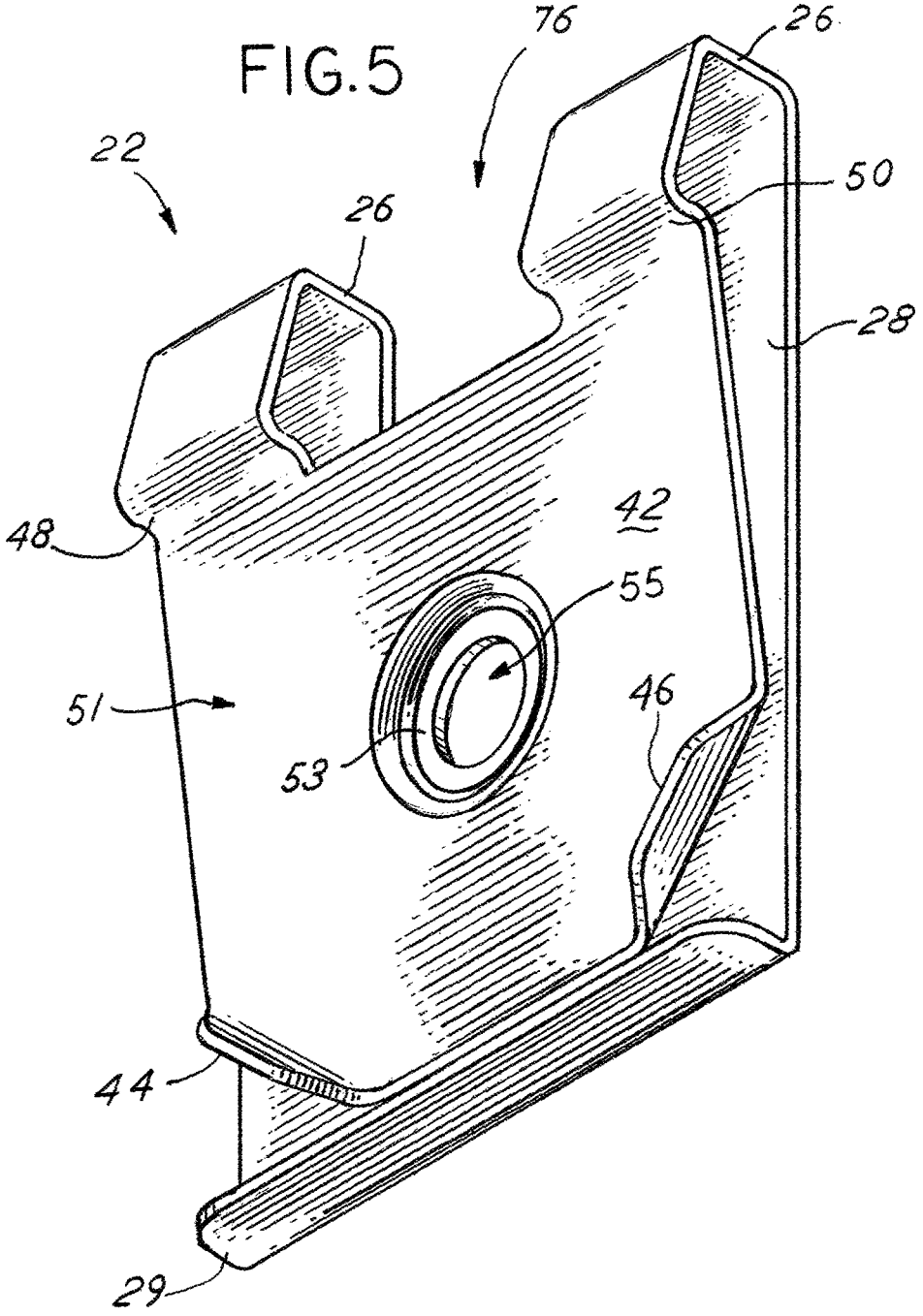
FIG. 5 is a front isometric view of the dress belt clip.

The dress belt clip 22, as shown in FIG. 4, is secured to a dress belt 10. This is accomplished by sliding it over to hold the dress belt 10 between a magnet engagement portion 24 and an inside wall 28. The dress belt clip 22 is shown individually in FIG. 5. The magnet engagement portion 24 is connected to the inside wall 28 through a top wall 26. The dress belt clip 22 is formed from spring or tempered steel, with the magnet engagement portion 24 being biased toward the inside wall 28, as shown in FIG. 5. The dress belt clip 22 is formed of spring steel and formed so that inside wall 28 and magnet engagement portion 24 firmly engages the dress belt 10 when installed, so that dress belt clip 22 cannot easily slide along the dress belt 10 once positioned relative to a duty belt clip 32. At the terminal edge of the inside wall 28 is a belt stop wall 29 that is bent towards the magnet engagement portion 24. If the dress belt clip 22 is pulled upwards, the belt stop wall 29 will contact the bottom edge 11 of the dress belt 10 to prevent inadvertent removal. The belt stop wall 29 helps prevent duty belt clips 32 from pulling dress belt clips 22 off a dress belt 10 when duty belt 12 is pulled upward forcefully such as when a public safety officer pulls a weapon out of a holster positioned on the duty belt or a third person tries to forcibly remove a weapon or other device 16 from a duty belt 12. This is shown in FIG. 4. The magnet engagement portion 24 has features that locate and retain the cup magnet 66 and duty belt clip 32. The magnet engagement portion 24 has a magnet engagement wall 42 that is bounded by lower magnet trap walls 44, 46 and upper magnet trap walls 48, 50, shown in FIG. 5. The lower magnet trap walls 44, 46 are formed by a bend that extends away from the magnet engagement wall 42. The upper magnet trap walls 48, 50 are formed by a bend that creates an angled wall 52. The trap walls 44, 46, 48, 50 form an effective area or pocket 51 that constrains the cup magnet 66 when it is attached to the magnet engagement wall 42. The magnet engagement wall 42 receives the cup magnet 66 when duty belt 12 is positioned adjacent the dress belt 10, shown in FIG. 3. The trap walls 44, 46, 48, 50 prevent the cup magnet 66 from sliding off of the magnet engagement wall 42 in the event the duty belt 12 is pulled or pushed relative to dress belt 10 in normal activities or when tools are being pulled out of or inserted into duty belt 12. Dress belt clips 22 are positioned on dress belt 10 to align with duty belt clips 32 positioned on duty belt 12.

It is contemplated that one or several of the trap walls 44, 46, 48, 50 are formed by a dimple, protrusion, or other feature. In one example, the magnet engagement portion 24 could extend directly to the top wall 26 with dimples that protrude outwardly to form the upper magnet trap walls 48, 50. The dimples would limit the magnet to be engaged in the effective pocket 51.

Figure 9:
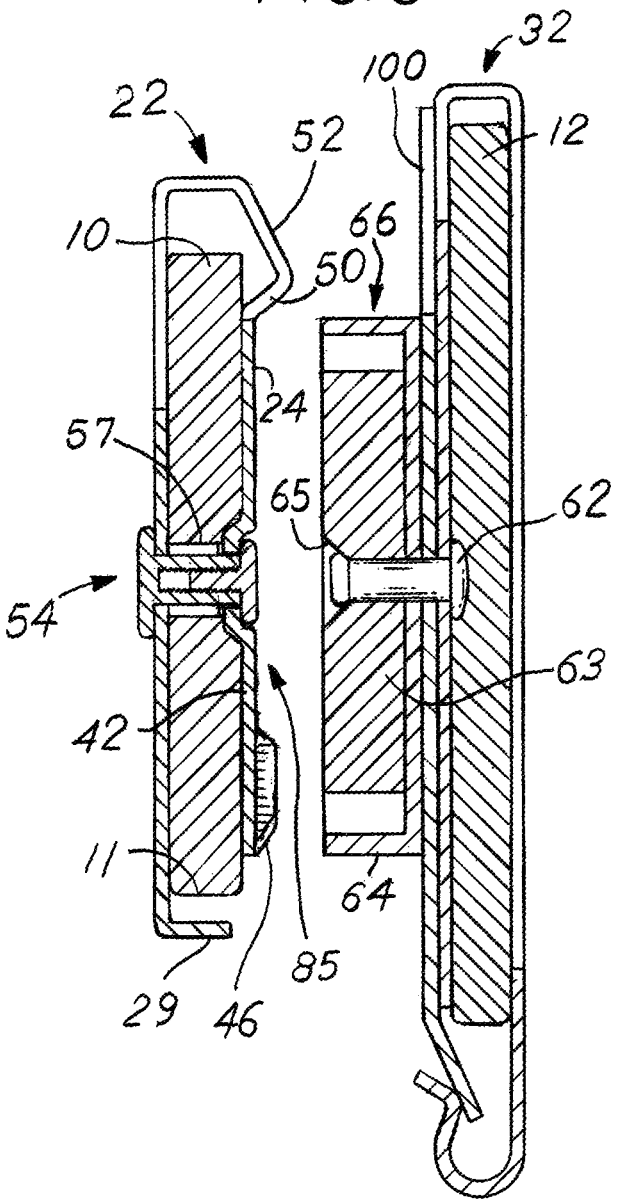
FIG. 9 is a section view 3-3 of the system as shown in FIG. 1 with a fastener affixing the dress belt clip to the dress belt and the dress belt clip disengaged from the duty belt clip.

The magnet engagement wall 42 may include a recess 53 with a dress belt retention aperture 55 that receives a retaining fastener 54. The dress belt clip 22 with a retaining fastener 54 is shown in FIG. 9 and is used to positively secure the dress belt clip 22 to the dress belt 10. The retaining fastener 54 affixes through the aperture 55 in the dress belt clip and a belt aperture 57 through the dress belt 10. The retaining fastener 56 shown herein is a "Chicago screw" style but other types are contemplated. This style of fastener is lower profile and has a smooth surface that faces the user to prevent snagging or wearing down of any fabric it contacts. The retaining fastener 56 prevents the dress belt clip 22 from sliding along the dress belt 10, which could create alignment issues with the duty belt clips 32 when the duty belt 12 is connected. When the retaining fastener 54 is used, it is contemplated that the stop wall 29 is not present.

Figure 6:
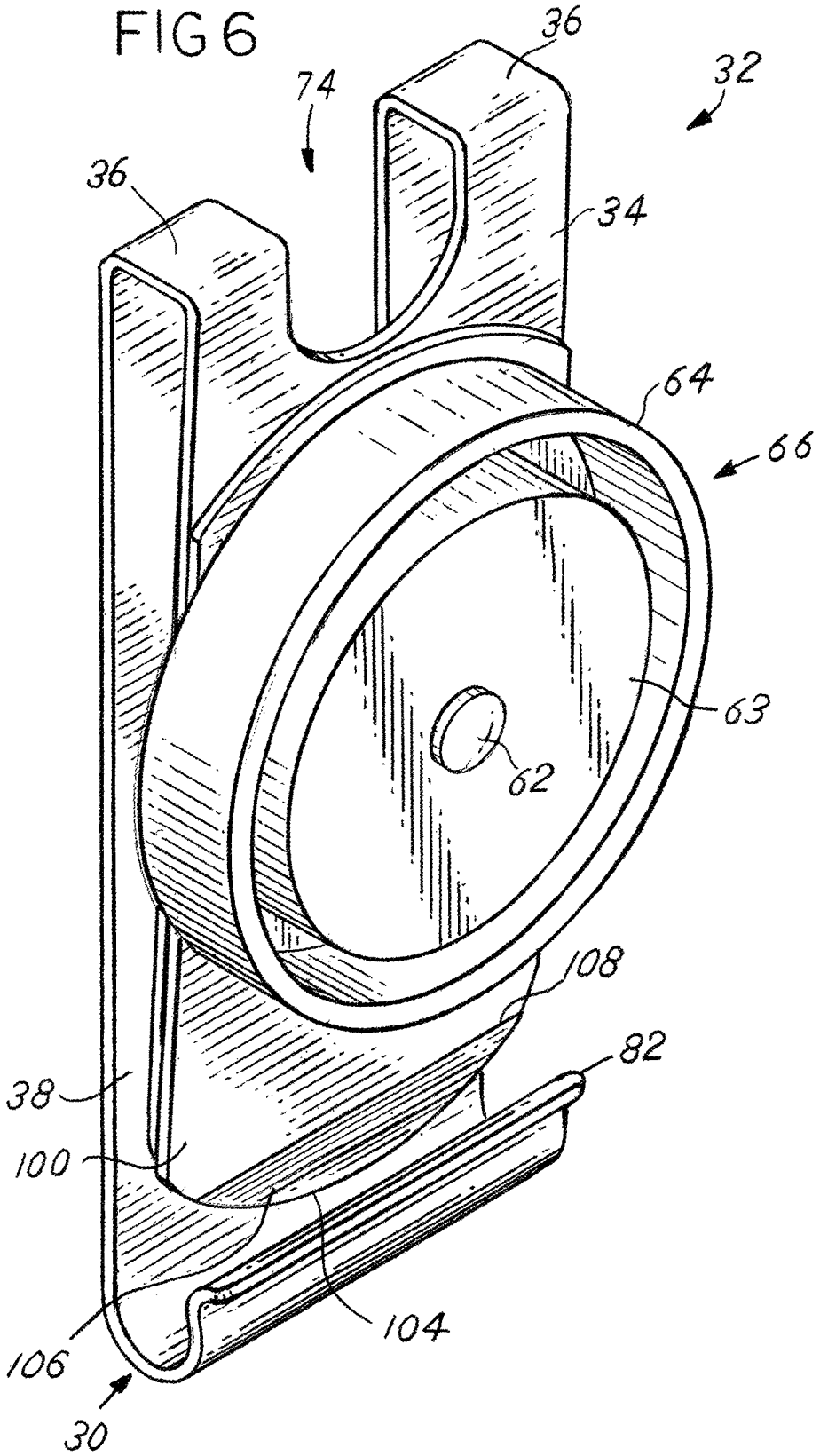
FIG. 6 is a front isometric view of the duty belt clip.

The duty belt clip 32, shown individually in FIG. 6, has a magnet support wall 34 that is connected to an outside wall 38 at a top wall 36. The duty belt clip 32, like the dress belt clip 22, is formed from spring or tempered steel. It has the magnet support wall 34 being biased towards the outside wall 38. The cup magnet 66 is shown as a neodymium cup magnet, but other magnet types are contemplated. As installed on the duty belt 12, the cup magnet 66 is attached to duty belt clip 32 and faces the magnet engagement wall 42. It has a metal back 64 to direct the magnetic field from the magnet 63 outward to improve holding power and prevent stray magnetic field from inadvertently erasing magnetic media, such as credit cards. The cup magnet 66 is secured to the duty belt clip 32 using a fastener 62. The cup magnet 66 has an aperture 65 that receives the fastener 62. The fastener 62 is shown as a rivet, but other fastening methods or devices are contemplated, such as a screw, bolt, epoxy, or other fastener that retains and affixes the cup magnet 66 to the magnet support wall 34 through a magnet retention aperture 40. As shown in FIG. 9, the fastener 62 protrudes through the magnet support wall 34 and can dig into the duty belt 12, providing additional stability and prevent the duty belt clip 32 from sliding along the length of the duty belt 12. The fastener 62 protrudes through the magnet support wall 34 and may protrude into the duty belt 12 to provide additional stability and prevent undesirable movement.

In order to provide sufficient holding power, the cup magnet 66 should have a holding force of greater than 65 pounds. Typically, cup magnets 66 with a holding force of 85-100 pounds provide adequate holding strength, but other magnet strengths are contemplated. While neodymium cup magnets are referred to herein, other magnets having a sufficient holding force could be used. As shown in FIG. 1, duty belt clips 32 are positioned on duty belt 12 between tool holders and accessories 16, also carried on the duty belt 12. Optionally, the duty belt clip 32 has a retainer hook 30 formed on the lower portion of outside wall 38. The retainer hook 30 has an overhanging wall portion 80 that overlays and is spaced from the outside wall 38. The overhanging wall portion 80 terminates at a hook edge 82 that is spaced from the magnet retention aperture 40 by a first distance 84. The retainer hook 30 can receive a retainer that can include a snap hook. The snap hook is used to clip on a key ring or other accessories desired to be carried on duty belt 12.

An optional duty belt retention clip 100 is shown in FIG. 6. As shown, it is held to the duty belt clip 32 through the fastener 62 that extends through a retention pivot aperture 102. It is contemplated that the duty belt retention clip 100 is connected to the duty belt clip 32 at a different location. The fastener 62 holds the cup magnet 66, magnet support wall 34, and retention clip 100 together. As shown, the duty belt retention clip 100 is an elongate component with a retention pivot aperture 102 and a terminal edge 104. The terminal edge 104 is spaced from the retention pivot aperture 102 by a second distance 112. Near the terminal edge 104, a bend 108 separates the retention clip 100 into a planar portion and an angled wall portion 106. The angled wall portion 106 is obliquely angled with respect to the planar portion. It is contemplated that the retention clip does not have the bend 108 and the terminal edge 104 is located on the planar portion. As shown, the terminal edge 104 is a smooth radius, but other shapes or profiles are contemplated. It is further contemplated that the duty belt retention clip 100 As attached to the duty belt clip 32, the retention clip 100 is secured to the magnet retention wall 34 with the retention pivot aperture 102 aligned with the magnet retention aperture 40. The retention clip 100 is capable of rotating about the retention pivot aperture 102 between a locked position and an unlocked position. In the locked position, a portion of the terminal edge 104 is located between the overhanging wall portion 80 of the retainer hook 30 and the outside wall 38. This completely surrounds the duty belt and is shown in FIG. 4. When installed on the duty belt 12, in the locked position, the retention clip 100 cooperates with the duty belt clip 32 and overhanging wall portion 80 to circumscribe the duty belt 12. The only way to release the duty belt 12 is to rotate the retention clip 100 to the unlocked position. A tab, handle, or other feature is contemplated on the duty belt retention clip 100 to make it easier for the user to move the clip 100 between the locked and unlocked position. While the embodiment described herein has the retention pivot aperture 102 aligned with the magnet retention aperture 40, it is contemplated that the retention pivot aperture 102 is attached to the duty belt clip 32 at a different location.

The duty belt clip 32 may include a slot 74 provided in the outside wall for weight reduction and allow the duty belt 12 to be visible through a slot. Similarly, the dress belt clip 22 may include a slot 76. It is contemplated that the duty belt clip 32 may be attached to a dress belt 10 with the dress belt clip 22 attached to a duty belt. Further, it is contemplated that the dress belt clip 22 has the cup magnet 66 affixed thereto with the magnet engagement portion 24 located on the duty belt clip 32.

Figure 7:
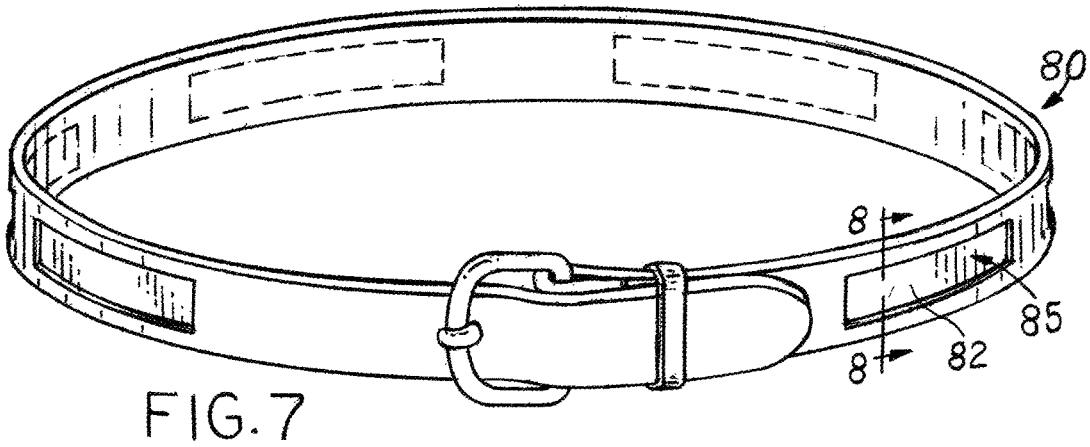
FIG. 7 is an isometric view of an alternate dress belt.
Figure 8:
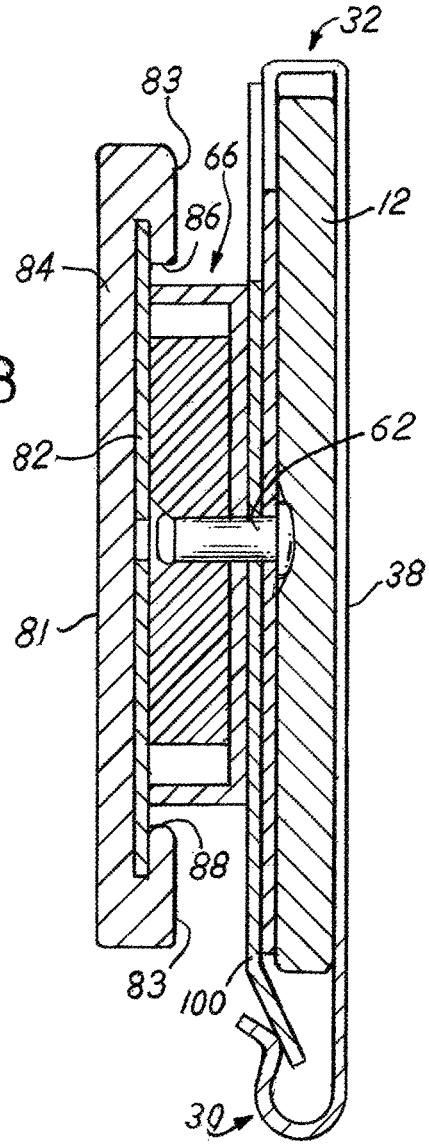
FIG. 8 is a section view 8-8 of the dress belt in FIG. 7 with the duty belt clip.

It is possible to integrate the dress belt clip magnet engagement portion into a dress belt 80, shown in FIGS. 7 and 8. Dress belt 80 is formed of leather or nylon or other belt materials and can have a belt buckle arranged to secure dress as is common in the belt art. Dress belt 80 has an inside surface 81 and an outside surface 83. The outside surface 83 includes a magnet engagement portion 82 that is recessed. The magnet engagement portion 82 is bordered by an upper trap edge 86 and a lower trap edge 88. The trap edges 86, 88 define an effective pocket 85 serve the same function as trap walls 44, 46, 48, 50 to prevent the magnet from sliding off of the magnet engagement portion 82. The magnet engagement portion 82 is recessed and securely affixed to the dress belt 80. As shown, the magnet engagement portion 82 is shown as a relatively long component, but it is contemplated the magnet engagement portions 82 are shorter. One method to securely affix it is by attaching layers of belt material to the belt material forming inside surface to retain magnet engagement portion 82. The magnet engagement portion 82 is formed of steel or other flexible/malleable magnetic material to engage the cup magnets 66 attached to duty belt clips. The recessed nature can not only allow cup magnet 66 to engage magnet engagement strip but can form upper and lower magnet trap surfaces similar to magnet trap walls 44 and 46 on dress belt clip 22.

It is possible to use another embodiment of the belt clip system without the use or need of a duty belt 12. The dress belt clip 22 is used to retain equipment to a dress belt 10 or 80 without a duty belt 12 by securing a cup magnet 66 to a holder for the desired equipment. For example, a handcuff case could have a cup magnet 66 attached to the inside wall of the handcuff case.

Terms such as "inside," "outside," "top," and "bottom" are used for descriptive purposes of components and portions and do not designate any limitations for orientation or position. It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A belt clip system for releasably securing a duty belt to a dress belt overlaid and circumscribed thereby, said system comprising:

a dress belt clip for attaching to said dress belt and having a magnet engagement portion overlaying and springedly connected to an inside wall, said magnet engagement portion having a magnet engagement wall with a first trap wall extending therefrom in a direction away from said inside wall, said magnet engagement portion having a second trap wall extending outwardly in a direction away from said inside wall, said magnet engagement wall and said trap walls cooperating to form an effective pocket, said inside wall having a belt stop wall extending from a terminal edge of said inside wall towards said magnet engagement portion;

a duty belt clip for attaching to said duty belt and having a magnet retaining portion overlaying and springedly connected to an outside wall, said magnet retaining portion having a permanent magnet affixed thereto at a magnet retention aperture, said permanent magnet facing away from said outside wall, said outside wall extending beyond said magnet retaining portion to a retainer hook, said retainer hook having an overhanging portion extending over said outside wall and terminating at a hook edge, said hook edge spaced from said magnet retention aperture by a first distance;

a retention clip pivotably affixed with respect to said magnet retaining portion between a locked and an unlocked position, said retention clip having a terminal edge spaced from a retention aperture by a second distance, when said retention clip is in said locked position, said terminal edge located between said outside wall and said overhanging portion; and said duty belt clip releasably held to said dress belt clip when said permanent magnet on said duty belt clip contacts said magnet engagement wall and resides in said effective pocket.

2. The belt clip system of claim 1, further comprising a fastener extending through a dress belt retention aperture in said magnet engagement wall, said fastener for extending through said dress belt retention aperture and a belt aperture in said dress belt to affix said dress belt clip to said dress belt.

3. The belt clip system of claim 1, wherein said duty belt clip includes a notch in said outside wall.

4. The belt clip system of claim 1, said permanent magnet affixed to said magnet retaining portion with a fastener, said fastener extending through said magnet retaining portion and partially into said duty belt when said duty belt clip is attached thereto.

5. A belt clip system for securing a duty belt to a dress belt overlaid and circumscribed thereby, said system comprising:

a dress belt clip having a magnet engagement portion overlaying and connected to an inside wall, said magnet engagement portion having a magnet engagement wall with a lower magnet trap wall extending therefrom in a direction away from said inside wall, said magnet engagement portion having an upper magnet trap wall extending outwardly in a direction away from said inside wall, said magnet engagement wall and said upper and lower magnet trap walls cooperating to form an effective magnet pocket;

a duty belt clip having a magnet retaining portion overlaying and connected to an outside wall, said magnet retaining portion having a permanent magnet affixed thereto at a magnet retention aperture, said permanent magnet facing away from said outside wall, said outside wall extending beyond said magnet retaining portion to a retainer hook, said retainer hook having an overhanging portion extending over said outside wall and terminating at a hook edge; and said duty belt clip releasably held to said dress belt clip when said permanent magnet on said duty belt clip contacts said magnet engagement wall in said effective magnet pocket between said upper magnet trap wall and said lower magnet trap wall.

6. The belt clip system of claim 5, further comprising a fastener extending through a dress belt retention aperture in said magnet engagement wall, said fastener for extending through said dress belt retention aperture and a belt aperture in said dress belt to affix said dress belt clip to said dress belt.

7. The belt clip system of claim 5, wherein said duty belt includes a notch in said outside wall.

8. The belt clip system of claim 5, wherein said inside wall having a belt stop wall extending towards said magnet engagement portion from a terminal edge of said inside wall.

9. The belt clip system of claim 5, further comprising a retention clip pivotably affixed with respect to said magnet retaining portion between a locked and an unlocked position, a portion of said retention clip located between said outside wall and said overhanging portion when said retention clip is in said locked position.

10. A duty belt clip system comprising:

a dress belt having a magnet engagement portion affixed thereto, said magnet engagement portion having an upper trap edge and a lower trap edge and a magnet engagement wall located therebetween, said upper and lower trap edges defining an effective pocket;

a duty belt clip having a magnet retaining portion overlaying and springedly affixed to an outside wall, said magnet retaining portion having a permanent magnet affixed thereto at a magnet retention aperture, said permanent magnet having an attracting wall facing away from said outside wall, said outside wall extending beyond said magnet retaining portion to a retainer hook, said retainer hook having an overhanging portion extending over said outside wall and terminating at a hook edge; and said duty belt clip releasably held to said dress belt when said permanent magnet on said duty belt clip contacts said magnet engagement portion between said upper trap edge and said lower trap edge.

11. The belt clip system of claim 10, further comprising a retention clip pivotably affixed with respect to said magnet retaining portion between a locked and an unlocked position, said retention clip having a terminal edge, when said retention clip is in said locked position, said terminal edge located between said outside wall and said overhanging portion.

12. The belt clip system of claim 10, said magnet engagement portion located on a dress belt clip, said magnet engagement portion having a dress belt retention aperture extending therethrough and aligned with a belt aperture, a fastener extending through said belt aperture and said dress belt retention aperture.

13. The belt clip system of claim 10, further comprising a retention clip pivotably affixed with respect to said magnet retaining portion between a locked and an unlocked position, said retention clip having a terminal edge, when said retention clip is in said locked position, said terminal edge located between said outside wall and said overhanging portion.

* * * * *